United States Patent [19]

Cullen et al.

[11] Patent Number: 4,994,185

[45] Date of Patent: Feb. 19, 1991

[54] COMBINED HEAT SHIELDING AND BONDING DEVICE FOR ADSORBENT PACKET IN REFRIGERANT RECEIVER

[75] Inventors: John S. Cullen, Buffalo; Samuel A. Incorvia, Tonawanda, both of N.Y.

[73] Assignee: Multiform Desiccants, Inc., Buffalo, N.Y.

[21] Appl. No.: 328,108

[22] Filed: Mar. 23, 1989

[51] Int. Cl.[5] ..... B01D 15/00; B01D 53/04

[52] U.S. Cl. ..... 210/282; 55/387; 62/474; 62/503; 210/DIG. 6

[58] Field of Search ..... 62/474, 503; 55/387; 210/282, DIG. 6

[56] References Cited

U.S. PATENT DOCUMENTS

| | | | |
|---|---|---|---|
| 3,734,296 | 5/1973 | Proctor et al. | 210/288 |
| 4,111,005 | 9/1978 | Livesay | 62/503 |
| 4,116,649 | 9/1978 | Cullen et al. | 55/387 |
| 4,187,695 | 2/1980 | Schumacher | 62/503 |
| 4,199,960 | 4/1980 | Adams | 62/503 |
| 4,270,934 | 6/1981 | Widdowson et al. | 55/316 |
| 4,276,756 | 7/1981 | Livesay | 62/503 |
| 4,291,548 | 9/1981 | Livesay | 62/503 |
| 4,401,447 | 8/1983 | Huber | 55/387 |
| 4,405,347 | 9/1983 | Cullen et al. | 55/387 |
| 4,457,843 | 7/1984 | Cullen et al. | 210/282 |
| 4,464,261 | 7/1984 | Cullen et al. | 210/282 |
| 4,474,035 | 10/1984 | Amin et al. | 62/503 |
| 4,496,378 | 1/1985 | Kish | 55/316 |
| 4,619,673 | 10/1986 | Cullen et al. | 55/387 |
| 4,866,951 | 9/1989 | Masterson | 62/503 |

*Primary Examiner*—Ivars Cintins

*Attorney, Agent, or Firm*—Joseph P. Gastel

[57] ABSTRACT

A combined heat shielding and bonding device for shielding an adsorbent packet from heat experienced during fabrication of a refrigerant receiver housing in which the packet is located and for bonding the adsorbent packet to conduits within the receiver including a planar flexible metal sleeve surrounding the adsorbent packet and conduits in the vicinity where the housing is to be welded to thereby conduct heat away from the packet during the welding process, and a film of heat-meltable plastic on the inside surface of the sleeve facing the adsorbent packet and the conduits for being melted by heat experienced during the welding process and thus effecting adhesion between the sleeve and the adsorbent packet and the conduits to thereby retain the packet in fixed relationship to the conduits.

16 Claims, 2 Drawing Sheets

COMBINED HEAT SHIELDING AND BONDING DEVICE FOR ADSORBENT PACKET IN REFRIGERANT RECEIVER

BACKGROUND OF THE INVENTION

The present invention relates to a combined heat shielding and bonding device for association with an adsorbent packet located within a refrigerant receiver.

By way of background, a refrigerant receiver of an air conditioning system comprises a metal housing containing a conduit structure for conducting refrigerant to and from the housing, and it also contains an adsorbent packet for adsorbing various impurities which may be contained in the refrigerant. In the past, the adsorbent packets were installed in a plurality of ways. It is common practice to weld two portions of the receiver housing to each other after the adsorbent packet has been positioned within the housing. The adsorbent packets usually contain fabric walls which consist of web-bonded polyester fibers or other types of fibers. If the adsorbent packet is too close to the portions of the housing being welded, the walls of the adsorbent packet can melt or otherwise be perforated, thereby spilling the contents with the attendant contamination of the refrigerant. Thus, in the past, various types of efforts were made to space the adsorbent packet walls sufficiently far from the housing being welded so that the adsorbent packet would not be opened. In addition, in the past, there were various ways of immobilizing the adsorbent packet relative to the conduits within the receiver housing to thereby obviate rubbing due to vibration in use which could form holes in the packet which could result in release of the adsorbent. It is with treating the foregoing problems that the present invention is concerned.

SUMMARY OF THE INVENTION

It is accordingly the primary object of the present invention to provide a combined heat shielding and bonding device for both shielding the adsorbent packet from the heat generated during welding of the housing and also simultaneously bonding the packet to conduit structure within the receiver to thereby stabilize it against undesired rubbing contact with portions of the receiver.

Another object of the present invention is to provide a highly simplified and highly effective heat shielding device for association with an adsorbent packet within a refrigerant receiver which is not only inexpensive to fabricate but also is simple to install. Other objects and attendant advantages of the present invention will readily be perceived hereafter.

The present invention relates to a heat shield device for shielding an adsorbent packet from heat experienced during welding of a refrigerant receiver housing in which an adsorbent packet is located and which has conduit structure therein comprising a metal member, and means securing said metal member to a portion of said adsorbent packet between said adsorbent packet and said housing in the vicinity of said welding, said metal member also being secured in contact with said conduit structure so that said metal member will conduct heat away from said adsorbent packet and into said conduit structure during fabrication of said weld. In its preferred form, the heat shield device includes adhesive on a surface thereof for causing the heat shield device to adhere to at least one of the adsorbent packet or conduits within the receiver, or it may be attached to the adsorbent packet and conduits by a metal tie. The various aspects of the present invention will be more fully understood when the following portions of the specification are read in conjunction with the accompanying drawings wherein:

DESCRIPTION OF THE PREFERRED EMBODIMENTS

Figures 1, 1A, 2, 3, 3A:
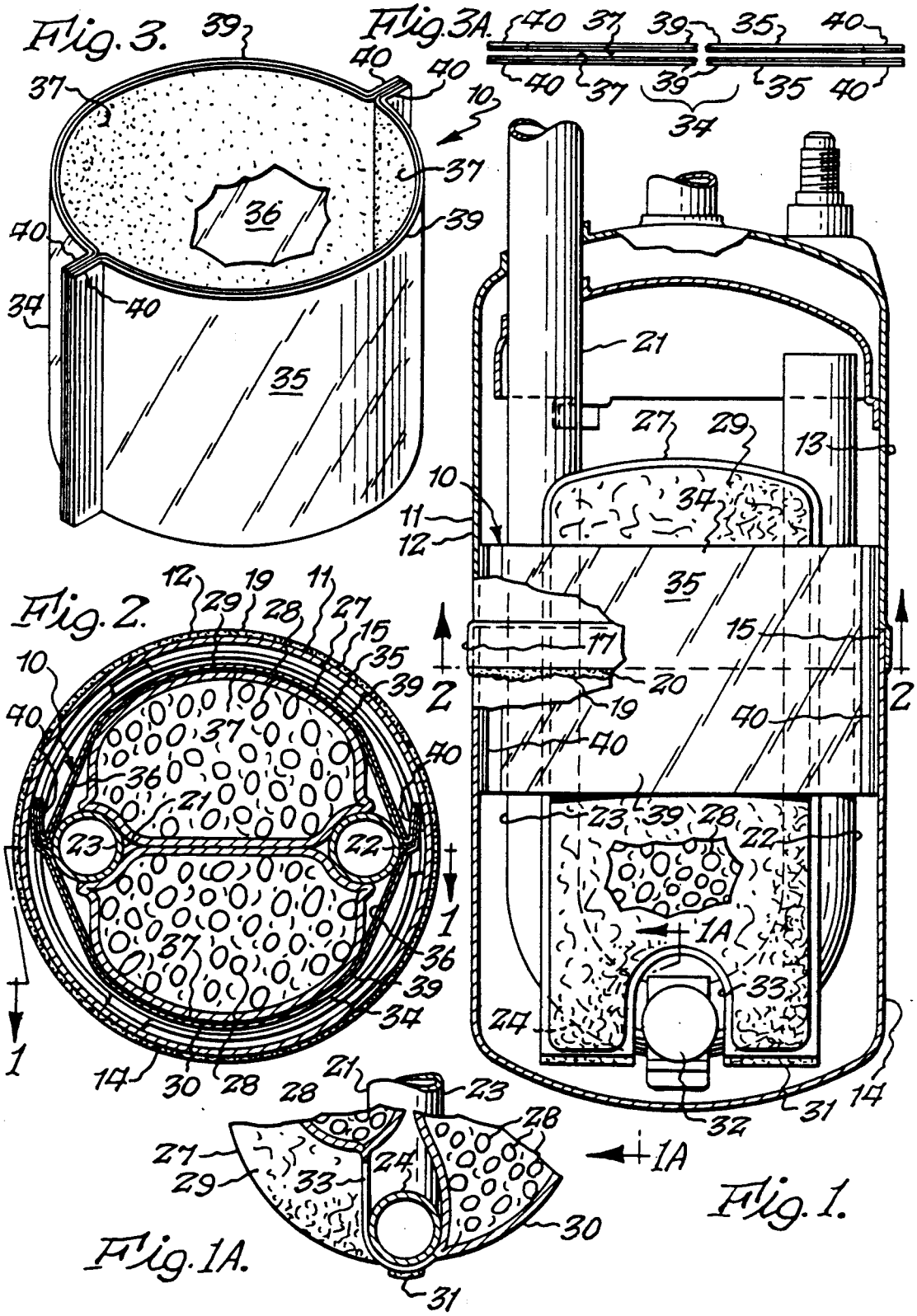
FIG. 1 is a fragmentary cross sectional view, mostly broken away, taken substantially along line 1—1 of FIG. 2 and showing an assembled refrigerant receiver with the combined heat shielding and bonding sleeve located proximate the weld of the receiver housing and bonding the adsorbent packet to the conduit within the receiver.
FIG. 1A is a fragmentary cross sectional view taken substantially along line 1A—1A of FIG. 1.
FIG. 2 is a cross sectional view taken substantially along line 2—2 of FIG. 1.
FIG. 3 is a perspective view of the combined heat shielding and bonding sleeve.
FIG. 3A is a fragmentary exploded view of the parts of the heat-conducting sleeve before it is expanded to a substantially cylindrical shape.

One embodiment of the combined heat shielding and bonding device 10 of the present invention is shown in FIGS. 1–3. In FIG. 1 it is shown in its operative position within refrigerant receiver 11 which is usually associated with an automotive air conditioning system. Receiver 11 includes a cylindrical housing 12 having an upper section 13 and a lower section 14, the upper portion 15 of which is telescoped into flange 17 of upper portion 13. A weld 19 extends circumferentially around the outer edge 20 of flange 17 to provide a fluid-tight seal between sections 13 and 14. Weld 19 is formed after the U-shaped conduit 21 having spaced legs 22 and 23 connected by return bend 24 is positioned within the upper portion 13 with adsorbent packet 27 fastened thereto by combined heat shielding and bonding device or sleeve 10 holding adsorbent packet 27 substantially in the position shown.

Adsorbent packet 27 is generally of the type shown in U.S. Pat. Nos. 4,401,447, issued Aug. 30, 1983, and 4,405,347, issued Sept. 20, 1983, in the sense that two spaced porous containers 29 and 30 are connected by a yoke portion 31 which lies under return bend 24. Each of the containers 27 and 30 contains a suitable adsorbent 28 which may be of any desirable composition and may selectively include, without limitation, adsorbents such as silica gel, metal alumino silicate, alumina, calcium sulfate, activiated charcoal, molecular sieve, or any other desired compound, in bead, pellet or granular form. A filter 32 is mounted on return bend 24 and is located within cutaway portion 33 in the adsorbent container 30. The other container 29 need not be cutaway, thereby permitting container 29 to contain a bit more adsorbent than container 30.

In accordance with the present invention, the combined heat shielding and bonding device 10 comprises a sleeve 34 having an outer layer 35 of sheet aluminum or any other suitable metal, and on the inner surface thereof is sheet polyethylene 37. Sleeve 34 is formed of two halves 39 which are bonded by fusing the polyethylene 37 on adjacent flanges 40. The sheet polyethylene 37 is fused to the inner surface 36 of each planar sheet 35.

Further in accordance with the present invention, the combined heat shielding and bonding device 10 is associated with the remainder of the parts of the receiver 11 in the following manner. The adsorbent packet 27 is mounted on conduit 21 with the outer edges of the containers 29 and 30 straddling conduits 23 and 25, as shown in FIGS. 1 and 2. Sleeve 34 is positioned as shown in FIG. 1 by sliding it over the assembled conduit 21 and adsorbent packet 27. This is effected by sliding sleeve 34 upwardly away from return bend 24 toward upper housing portion 13. The containers 29 and 30 are compressible because the adsorbent 28 can be squeezed together within flexible containers 29 and 30. The sleeve 34 is dimensioned so that it will fit tightly in the positions shown in FIGS. 1 and 2 after containers 29 and 30 have been compressed, and thus it holds the packet 27 in position prior to the assembling of housing portions 13 and 14. After sleeve 10 has been installed, lower housing portion 14 has its portion 15 telescoped into flange 17 of upper housing portion 13. Thereafter, the entire circumferential seam is welded at 19 to provide a fluid-tight joint between flange edge 20 and the adjacent portion of lower housing portion 14.

There will be considerable heat generated at the weld area 19 during the fabrication process. In accordance with the present invention, the aluminum planar sheet material 35 will conduct heat away from the sides of containers 29 and 30, thereby preventing them from melting, considering that they are made out of web-bonded polyester fiber which will normally melt at the temperatures to which they are exposed while the weld 19 is produced. Furthermore, the heat which is applied to the sheet aluminum 34 will melt the polyethylene layer 37 on its inner surface, and thus the melted polyethylene will function as an adhesive to bond the sleeve 34 to the spaced conduits 22 and 23 and also bond the sleeve 34 to the outer surfaces of containers 29 and 30 which are in contiguous abutting relationship with the polyethylene layer on sleeve 34. It can be seen that because the metal sleeve is in direct contact with the conduits 22 and 23, both when it is uncoated and after the polyethylene coating has melted, any heat picked up by the metal sleeve will be conducted into the conduits 22 and 23, which, in turn, will conduct the heat away from the adsorbent packet 27. It is also to be noted that as shown in FIG. 2, flange portions 40 contact the inner surface of the housing in the vicinity of the weld 19 to thereby provide a direct heat path to conduits 22 and 23, and while this is a desirable refinement, it will be appreciated that flange portions 40 may be spaced from the internal surface of housing 11. Also, the shiny side of the aluminum 34 faces the housing, and thus reflects heat away from the adsorbent packet. In addition, the polyethylene layer provides a certain amount of insulation between the adsorbent packet and the metal layer 34. Thus, as described above, the sleeve 34 is a combined heat shielding and bonding device in that it shields the adsorbent packet 27 from the welding heat, and the welding heat also bonds the adsorbent packet 27 to conduits 22 and 23, thereby preventing it from moving relative to such conduits, which could ultimately result in a rubbing action during use which could wear holes in containers 29 and 30. In addition, sleeve 34 functions as a device for retaining adsorbent packet 27 in assembled relationship with conduits 22 and 23 prior to the installation of lower housing portion 14.

The subject matter of adsorbent packet 27 was described only briefly above but it will be appreciated that it can contain the various salient structural features set forth in U.S. Pat. Nos. 4,401,447 and 4,405,347 and U.S. Pat. No. 4,272,264, issued June 9, 1981, all of which are incorporated herein by reference.

It will be appreciated that while it is preferable to have the polyethylene laminate on the inside surface of flexible metal planar sheets 35, if desired, only a tubular metal sleeve may be used without the polyethylene, and, if bonding is desired, other bonding agents than a layer of polyethylene sheeting can be used. The advantage of a heat-meltable plastic, such as polyethylene, is that it will melt to act as an adhesive but it will be chemically inert so as not to deleteriously affect the refrigerant. In certain circumstances, only the heat dissipating characteristic of the sleeve may be required, in which event the bonding aspect may be eliminated. Furthermore, while sleeve 34 has been shown in substantially cylindrical form in FIG. 3, it will be appreciated that it normally assumes a substantially planar configuration when fabricated with the inner surfaces of the polyethylene 37 in abutting relationship, as shown in exploded from in FIG. 3A.

Figure 4:
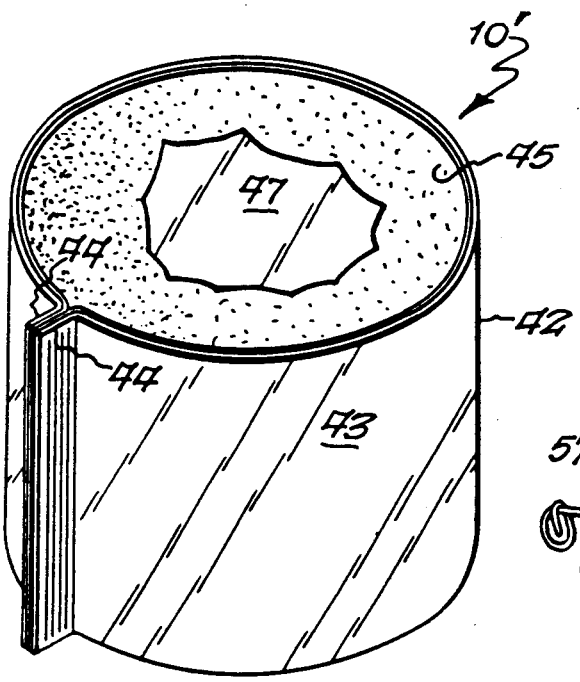
FIG. 4 is a perspective view of a modified embodiment of the combined heat shielding and bonding sleeve.

In FIG. 4 a modified embodiment of a combined heat shielding and bonding device is shown. This embodiment comprises a sleeve 42 fabricated from a single flexible sheet of aluminum 43 having its end portions formed into flanges 44 which are bonded to each other by applying heat to the outer surfaces thereof to thereby fuse the polyethylene inner layer 45 which is coated onto inner surface 47 of metal 43 to itself. The only difference between the embodiment of FIGS. 1–3 and the embodiment of FIG. 4 is that the latter is fabricated from a single piece turned on itself whereas the former is fabricated from two pieces of polyethylene coated metal.

Figure 6:
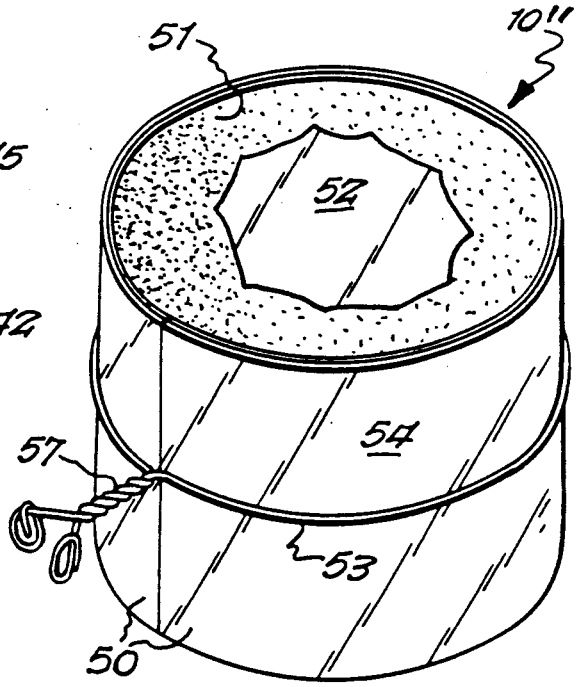
FIG. 6 is a perspective view of the shape which the embodiment of FIG. 5 assumes when it is wound around an assembled adsorbent packet and receiver conduits.
Figure 5:
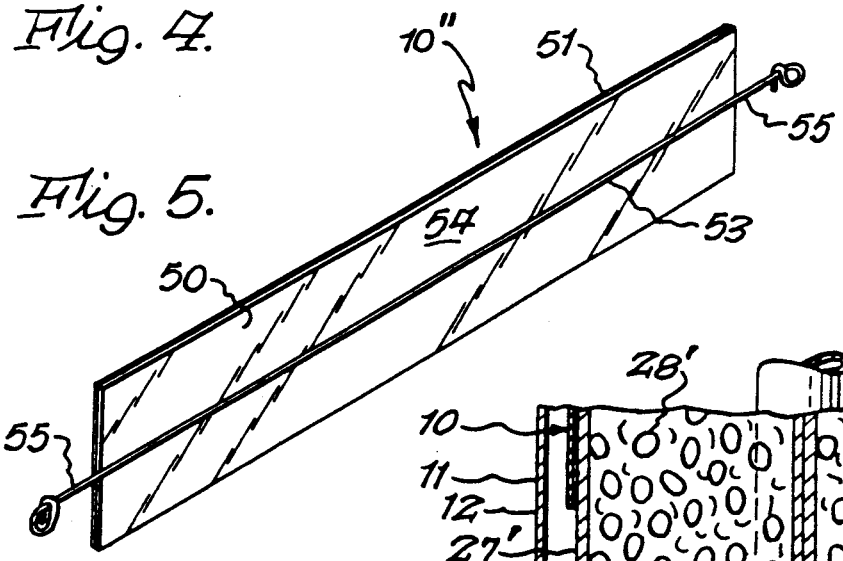
FIG. 5 is a perspective view of a further modified embodiment of a combined heat shielding and bonding sleeve.

A still further embodiment of the present invention is shown in FIGS. 5 and 6 wherein a combined heat shielding and bonding device 10″ consists of a planar sheet 50 of aluminum having a laminate of polyethylene 51 on its inner surface 52 when the device 10″ is formed as shown in FIG. 6. In this respect, a metal wire 53 has a central portion which is bonded to the outer surface 54 of metal 50, and it has outer end portions 55 which extend beyond sheet 50. In use, after the adsorbent container 27 is placed in a position, such as shown in FIG. 1, device 10″ is wound around the adsorbent container 27 and conduits 22 and 23, and the outer ends 55 of wire tie 53 are twisted a shown at 57 to securely fasten adsorbent container 27 in position between conduits 22 and 23. When the housing is subjected to the heat during application of weld 19, the polyethylene lining 51 will fuse the device 10'' to both the adsorbent packet 27 and conduits 22 and 23. Also, as an alternative structure, the embodiment of FIG. 5 may be fabricated with the wire 53 sandwiched between two metal sheets such as 50.

As noted above relative to FIGS. 3 and 4, the depicting of the devices 10, 10' and 10'' in cylindrical form is to generally represent the shape they assume when they are in their installed positions. Furthermore, as noted above relative to the embodiment of FIGS. 1–3, the embodiments of FIGS. 4 and 5 also may or may not have polyethylene sheeting bonded to the inner surface of the flexible metal planar sheets, or other bonding agents can be used.

By way of example and not of limitation, the combined heat shielding and bonding device, such as 10, 10' and 10'', is preferably an aluminum-polyethylene sandwich laminate wherein 0.0007 inches aluminum is sandwiched between about 0.0011 inches of polyethylene on the outside surface and 0.0022 inches of polyethylene on its inside surface which faces the adsorbent packet. This is specified as "Type PFX-10 Laminent 195 MSBO×7-10# Polyethylene×0.0007" Alum. Foil×22# Polyethylene per SP 42.4." The weight of the material is approximately $19.74\times10^{-5}$ lb/in$^2$. However, other materials may be used.

Figure 7:
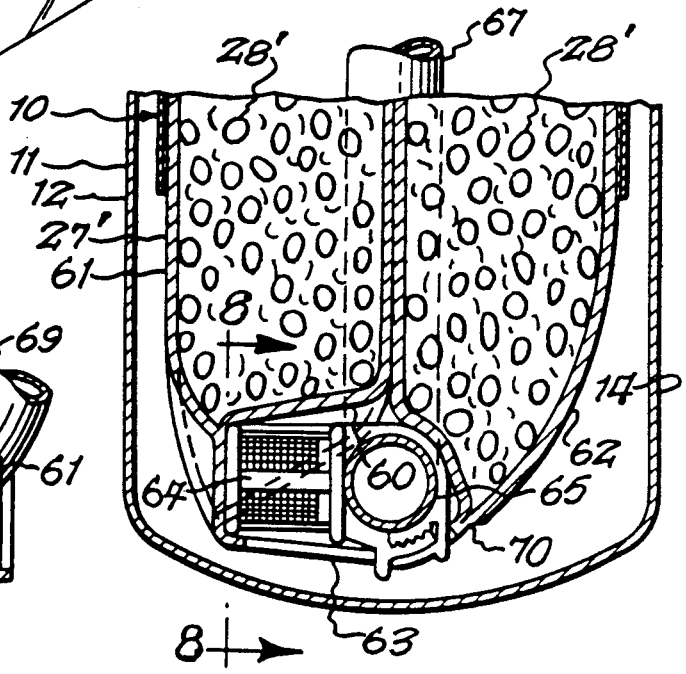
FIG. 7 is a fragmentary cross sectional view, taken substantially along line 7—7 of FIG. 8, and showing the bottom portion of a refrigerant receiver with a modified adsorbent bag construction therein.
Figure 8:
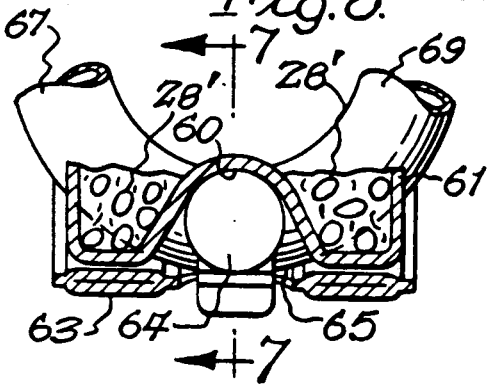
FIG. 8 is a fragmentary cross sectional view taken substantially along line 8—8 of FIG. 7.

In FIGS. 7 and 8 a construction of an adsorbent packet 27' is shown wherein a depression or pocket 60 is located in the container 61 which is secured to container 62 by yoke 63. The pocket 60 of container 61 receives filter 64 which is suitably attached to return bend 65 between conduit legs 67 and 69. Container 62 extends all the way down to point 70. By having a pocket 60 in the container 61 to receive filter 64, a greater amount of adsorbent can be provided by the adsorbent packet 27' than if this pocket was not present because adsorbent material in container 61 on opposite sides of pocket 60 can extend practically all the way to yoke 63.

While the preferred embodiments of the present invention have disclosed the various sleeves as encircling both the adsorbent packet and the conduits 22 and 23, it is within the scope of the present invention to have a sleeve encircling only the adsorbent containers but lying within conduits, such as 22 and 23. Furthermore, while the metal member for conducting heat away from the adsorbent packet has been described as being planar, it will be appreciated that it may have more thickness than depicted in the drawings and that it may be shaped differently.

While preferred embodiments of the present invention have been disclosed, it will be appreciated that it is not limited thereto but may be otherwise embodied within the scope of the following claims.

What is claimed is:

1. In a refrigerant receiver having a housing with a weld thereon and internal conduit structure within said housing and an adsorbent packet within said housing comprising a combined heat shielding and bonding device for shielding said adsorbent packet from heat experienced during fabrication of said weld and for bonding said adsorbent packet to said internal conduit structure comprising sheet metal means having first and second surfaces on opposite sides thereof, said sheet metal means being positioned in a direct line between said adsorbent packet and said weld and having a sufficient expanse to conduct sufficient heat away from said adsorbent packet during fabrication of said weld to prevent damage to said adsorbent packet from said heat, and securing means for securing said sheet metal means to both said adsorbent packet and said integral conduit structure.

2. In a refrigerant receiver as set forth in claim 1 wherein said securing means comprises an elongated tie member encircling both said adsorbent packet and said conduit structure.

3. In a refrigerant receiver as set forth in claim 1 wherein said securing means comprises a friction fit.

4. In a refrigerant receiver having a housing with a weld thereon and internal conduit structure within said housing and an adsorbent packet within said housing comprising a heat shield device for shielding said adsorbent packet from heat experienced during fabrication of said weld comprising a planar metal means of sufficient expanse to conduct a sufficient amount of heat away from said adsorbent packet during fabrication of said weld to prevent damage of said adsorbent packet from said heat, and securing means securing said planar metal means to a portion of said adsorbent packet between said absorbent packet and said housing in a line between said adsorbent packet and said weld and in contact with said internal conduit structure to conduct heat away form said adsorbent packet during fabrication of said weld.

5. In a refrigerant receiver as set forth in claim 4 wherein said securing means comprises a tie member.

6. In a refrigerant receiver as set forth in claim 4 wherein said securing means comprises a friction fit between said absorbent packet and said metal member.

7. In a refrigerant receiver as set forth in claim 4 wherein said planar metal means encircles both said adsorbent packet and said conduit structure.

8. In a refrigerant receiver as set forth in claim 4 wherein said planar metal means is positioned in total encircling relationship to said adsorbent packet.

9. In a refrigerant receiver having a housing with a weld thereon and internal conduit structure within said housing and an adsorbent packet within said housing comprising a combined heat shielding and bonding device for shielding said adsorbent packet from heat experienced during fabrication of said weld and for bonding said adsorbent packet to said internal conduit structure comprising a metal member having first and second surfaces on opposite sides thereof, said metal member being positioned between said adsorbent packet and said weld, and securing means for securing said metal member to both said adsorbent packet and said internal conduit structure, said securing means comprising an elongated tie member encircling both said absorbent packet and said conduit structure, and said tie member comprising a metal wire located between said metal member and said housing.

10. In a refrigerant receiver as set forth in claim 9 wherein said tie member includes a portion bonded to said metal member.

11. In a refrigerant receiver having a housing with a weld thereon and internal conduit structure within said housing and an adsorbent packet within said housing comprising a combined heat shielding and bonding device for shielding said adsorbent packet from heat experienced during fabrication of said weld and for bonding said adsorbent packet to said internal conduit structure comprising a metal member having first and second surfaces on opposite sides thereof, said metal member being positioned between said adsorbent packet and said weld, and securing means for securing said metal member to both said adsorbent packet and said internal conduit structure, said metal member comprising a sleeve which encircles both said absorbent packet and said conduit structure, an inner surface on said sleeve facing both said absorbent packet and said conduit structure, and said securing means comprising adhesive material on said inner surface.

12. In a refrigerant receiver as set forth in claim 11 wherein said adhesive material engages both said adsorbent packet and said conduit structure.

13. In a refrigerant receiver as set forth in claim 11 wherein said adhesive material comprises a layer of heat-fusible plastic.

14. In a refrigerant receiver as set forth in claim 13 wherein said heat-fusible plastic bonds to both said adsorbent packet and said internal conduit structure.

15. In a refrigerant receiver having a housing with a weld thereon and internal conduit structure within said housing and an adsorbent packet within said housing comprising a heat shield device for shielding said adsorbent packet from heat experienced during fabrication of said weld comprising a planar metal member of sufficient expanse to conduct a sufficient amount of heat away from said adsorbent packet to prevent damage of said packet by said heat experienced during fabrication of said weld, and securing means securing said planar metal member to a portion of said adsorbent packet between said adsorbent packet and said housing in the vicinity of said weld and in contact with said internal conduit structure to conduct heat away from said adsorbent packet during fabrication of said weld, said securing means comprising adhesive.

16. In a refrigerant receiver as set forth in claim 15 wherein said adhesive comprises heat-fusible plastic.

* * * * *

UNITED STATES PATENT AND TRADEMARK OFFICE

CERTIFICATE OF CORRECTION

PATENT NO. : 4,994,185

DATED : February 19, 1991

INVENTOR(S) : John S. Cullen et al

It is certified that error appears in the above-identified patent and that said Letters Patent is hereby corrected as shown below:

Column 4, line 66, change "a" to --as--.

Column 5, line 13, after "surface" insert --thereof. Additionally, if desired, the polyethylene sheeting may only be applied to select portions of the inner surface--.

Column 6, line 4 (claim 1), change "integral" to --internal--.

Signed and Sealed this

Thirtieth Day of June, 1992

*Attest:*

DOUGLAS B. COMER

*Attesting Officer*

*Acting Commissioner of Patents and Trademarks*